US011800286B2

(12) United States Patent
Bouvigne

(10) Patent No.: US 11,800,286 B2
(45) Date of Patent: Oct. 24, 2023

(54) MODULAR AUDIO PLAYBACK EQUIPMENT

(71) Applicant: SAGEMCOM BROADBAND SAS, Rueil Malmaison (FR)

(72) Inventor: Gabriel Bouvigne, Rueil Malmaison (FR)

(73) Assignee: SAGEMCOM BROADBAND SAS, Rueil Malmaison (FR)

( * ) Notice: Subject to any disclaimer, the term of this patent is extended or adjusted under 35 U.S.C. 154(b) by 0 days.

(21) Appl. No.: 17/704,941

(22) Filed: Mar. 25, 2022

(65) Prior Publication Data

US 2022/0312118 A1 Sep. 29, 2022

(30) Foreign Application Priority Data

Mar. 26, 2021 (FR) ..... 2103104

(51) Int. Cl.
*H04R 5/04* (2006.01)
*H04R 3/12* (2006.01)

(52) U.S. Cl.
CPC ..... *H04R 5/04* (2013.01); *H04R 3/12* (2013.01); *H04R 2205/024* (2013.01); *H04R 2205/026* (2013.01); *H04R 2420/07* (2013.01)

(58) Field of Classification Search
None
See application file for complete search history.

(56) References Cited

U.S. PATENT DOCUMENTS

| | | | | |
|---|---|---|---|---|
| 8,311,254 | B2 * | 11/2012 | Lipsky | H04R 1/26 381/334 |
| 9,301,031 | B2 * | 3/2016 | Gengler | H04R 5/02 |
| 10,117,022 | B1 * | 10/2018 | Brennan | H04R 1/02 |
| 11,381,903 | B2 * | 7/2022 | Wilker | G10L 15/22 |
| 2013/0039527 | A1 * | 2/2013 | Jensen | H04R 1/24 381/387 |
| 2013/0259283 | A1 * | 10/2013 | Gengler | H04R 5/02 381/334 |

(Continued)

FOREIGN PATENT DOCUMENTS

CN 111787461 A 10/2020

OTHER PUBLICATIONS

Speaker Fanatic, "Ashley Chloe Ensembl—Stylish, Modular Smart Speaker Concept", (https://speakerfanatic.com/ashley-chloe-ensembl-stylish-modular-smart-speaker-concept), pp. 1-5. (Year: 2018).*

(Continued)

*Primary Examiner* — Paul W Huber
(74) *Attorney, Agent, or Firm* — Muncy, Geissler, Olds & Lowe, P.C.

(57) ABSTRACT

Modular equipment includes a main module that has a main speaker, main communication components arranged to implement at least one wireless communication, power supply components arranged to acquire main power supply from the mains, main assembly means arranged to assemble the main module with one or more additional modules, a processor component arranged to detect if the main module is assembled with a first additional module comprising one or more microphones and, if this is the case, to activate at least one additional function implemented by the equipment and using the microphone(s).

18 Claims, 7 Drawing Sheets

(56) References Cited

U.S. PATENT DOCUMENTS

| | | | | |
|---|---|---|---|---|
| 2019/0037307 | A1 | 1/2019 | Zimmerman et al. | |
| 2020/0128328 | A1 | 4/2020 | Liniado et al. | |
| 2021/0281938 | A1* | 9/2021 | Pavelic ..... | H04R 1/025 |

OTHER PUBLICATIONS

Lynn, La, "Ensembl modular speaker lets you hot-swap and stac parts on the fly," Jan. 8, 2018, https://www.cnet.com/home/smart-home/ashley-chloe-ensembl-ces-2018-modular-smart-home-speaker/, 4 pages.

* cited by examiner

MODULAR AUDIO PLAYBACK EQUIPMENT

The invention relates to the field of audio playback equipment, and in particular to smart speakers.

BACKGROUND OF THE INVENTION

A smart speaker conventionally comprises a set of microphones and can be used to implement the voice recognition method of a virtual personal assistant.

It is possible for some users to be seduced by a particular model of such a smart speaker, without however being interested in voice recognition. In this case, the set of microphones is useless and can even discourage users from acquiring the smart speaker, for example because they consider that the cost of the smart speaker is too high with respect to the use they make of it, or because the presence of the microphones disturbs them.

Some users, for their part, wish to use the set of microphones to benefit from voice recognition, and consider positioning their smart speaker in a low position, for example on the ground or on a table, a desk, a sideboard, etc. It is therefore preferable for these users, in order to optimise the capture of sound signals, for the set of microphones to be positioned on a top part of the smart speaker. Of course, when users consider positioning their smart speaker in a high position, for example at the top of a shelf, it is preferable for the set of microphones to be positioned on a lower part of the speaker.

Some users assign their smart speaker for "sedentary" use, the smart speaker therefore remaining powered by the mains, while others prefer mobile use, such that the presence of a battery is necessary.

It is therefore very difficult for the user to find a smart speaker which corresponds specifically to his expectations, both in terms of available functionalities and also in terms of cost. The choice is all the more difficult because it is irrevocable: when the user has chosen a product, it is generally impossible for him to add new functionalities to this product.

It is also difficult for the manufacturer to define the products that he designs. The most obvious solution to satisfy all users would consist of commercialising numerous different products, each provided with different separate functionalities (a "single speaker" product, a "smart speaker" product, a product with a battery, etc.). However, this solution has a significant cost since the manufacture of each product requires a separate production line. Moreover, this solution makes it impossible to extend uses on a product which does not comprise optional functionalities (for example, the set of microphones or the battery).

SUBJECT MATTER OF THE INVENTION

The invention aims for audio playback equipment adapted to the desires of a large majority of users and inexpensive to manufacture.

SUMMARY OF THE INVENTION

In order to achieve this aim, there is provided modular audio playback equipment comprising a main module arranged to operate individually or by being assembled with one or more additional modules comprising a first additional module comprising at least one microphone, the main module comprising:

audio playback components comprising a main speaker;

main communication components arranged to implement at least one wireless communication;

power supply components arranged to acquire a main power supply from the mains and to power the equipment from the main power supply;

main assembly means arranged to assemble the main module with the additional module(s);

a processor component arranged to detect if the main module is assembled with the first additional module and, if this is the case, to activate at least one additional function implemented by the equipment and using the microphone(s).

The main module is therefore the basic module of the different versions of the modular audio playback equipment according to the invention, which is for example a speaker.

The user who wishes to have equipment without a microphone is therefore not provided with the first additional module, while the user who wishes to implement a voice recognition method is provided with said first additional module.

The main assembly means can possibly make it possible to position the first additional module in an upper position above the main module or in a lower position below the main module, such that the user can adapt the equipment to its low (on a table) or high (on a shelf) position in order to optimise the capture achieved by the microphones.

The first additional module can comprise a battery, possibly detachable from the microphones, such that the user can configure his speaker for sedentary use or for mobile use.

The equipment according to the invention therefore makes it possible to satisfy the wishes of a large majority of users.

All these different configurations have in common the same basic module, which is the main module, which significantly reduces the costs of designing but also of manufacturing the equipment. A relatively small number of additional modules makes it possible to meet the expectations of a very large number of users, which improves the attractiveness of the equipment and again reducing its cost.

Also, there is proposed an equipment such as described above, the first additional module additionally comprising a battery arranged to supply power to the equipment when this is not connected to the mains.

Also, there is proposed an equipment such as described above, the first additional module additionally comprising a battery arranged to supply power to the first additional module when this is not connected to the mains.

Also, there is proposed an equipment such as described above, the first additional module comprising a first unit comprising the microphone(s) and a second unit comprising the battery, the first unit and the second unit being detachable and each being capable of being assembled individually with the main module.

Also, there is proposed an equipment such as described above, the processor component being arranged to detect if the main module is connected to the mains or not, and to adapt a power supply profile of the equipment according to the result of this detection.

Also, there is proposed an equipment such as described above, the first additional module comprising first communication components arranged to communicate with the main communication components of the main module via wireless communication, the main module being arranged to, when the main module and the first additional module are not assembled, receive via wireless communication, audio signals produced by the microphone(s) of the first additional module to implement the additional function(s).

Also, there is proposed an equipment such as described above, in which the main assembly means are arranged to enable the first additional module to be positioned as desired in an upper position above the main module or in a lower position below the main module.

Also, there is proposed an equipment such as described above, in which one of the upper position or lower position is a hiding position in which the microphone(s) of the first additional module are hidden.

Also, there is proposed an equipment such as described above, the main assembly means comprising a lip which extends over a periphery of the main module, the first additional module comprising a shoulder defining a recess over a periphery of the first additional module, the main module and the first additional module being arranged such that, when the main module and the first additional module are assembled according to the hidden position, the lip is positioned in the recess and hides the microphone(s) which are then acoustically isolated from the outside.

Also, there is proposed an equipment such as described above, in which pins, arranged to implement an electrical connection between the main module and the first additional module, extend from an internal surface of the lip.

Also, there is proposed an equipment such as described above, in which the additional modules comprise a second additional module comprising one or more additional speakers.

Also, there is proposed an equipment such as described above, in which the main speaker(s) comprise(s) a medium speaker and/or a treble speaker and in which the additional speaker(s) comprise(s) a bass speaker.

Also, there is proposed an equipment such as described above, the processor component being arranged to detect if the main module is assembled or not with the second additional module and to adapt an audio profile applied by the equipment according to the result of this detection.

Also, there is proposed an equipment such as described above, the equipment being a speaker.

Also, a management method is proposed, implemented in equipment such as described above, and comprising steps:

- of detecting if the main module is assembled with the first additional module;
- if this is the case, of activating the additional function(s) implemented by the equipment and using the microphone(s).

In addition, a management method such as described above is proposed, further comprising steps, if the main module is not assembled with the first additional module:

- of activating wireless communication to attempt to detect the first additional module;
- if the first additional module is detected, of connecting the main module with the first additional module and of activating the additional function(s) implemented by the equipment and using the microphone(s).

In addition, a management method such as described above is proposed, further comprising steps:

- of detecting if the main module is assembled or not with a second additional module comprising an additional speaker;
- of adapting an audio profile applied by the equipment according to the result of this detection.

In addition, a management method such as described above is proposed, further comprising steps:

- of detecting if the main module is connected to the mains supply or not;
- of adapting a profile of powering equipment according to the result of this detection.

Also, a computer program is proposed comprising instructions which lead to the processor component of the main module of equipment such as described above executing the steps of the management method such as described above.

Also, a recording medium which can be read by a computer is proposed, on which the computer program such as described above is recorded.

The invention will be better understood in the light of the following description of a particular, non-limiting embodiment of the invention.

BRIEF DESCRIPTION OF THE DRAWINGS

Reference will be made to the appended drawings, from among which.

DETAILED DESCRIPTION OF THE INVENTION

Figure 1:
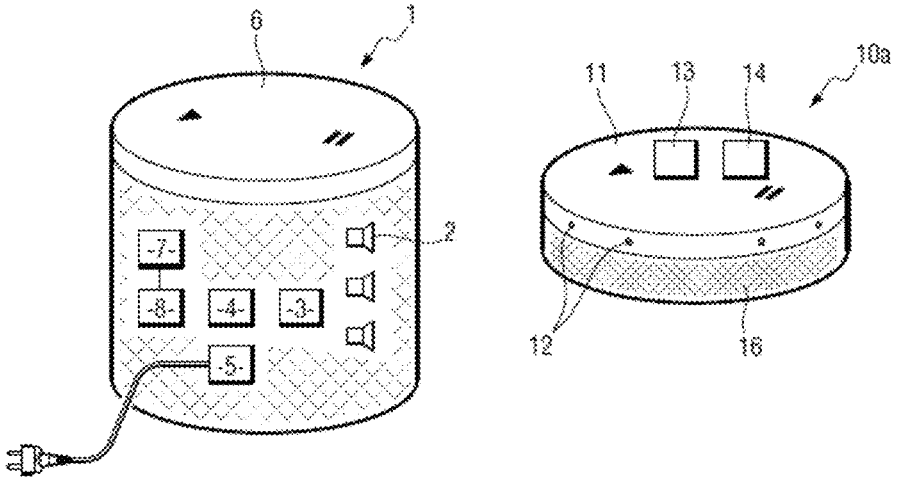
FIG. 1 shows a main module and a first additional module according to a first embodiment of a smart speaker which is not assembled.

With reference to FIG. 1, the modular audio playback equipment of the invention is in this example a speaker. The speaker first comprises a main module 1.

The main module 1 is in itself a separate equipment, which can operate individually or else by being assembled with one or more additional modules.

Here, the main module 1 has a cylindrical shape, although other shapes are possible, such as a right prism, for example.

The main module 1 first comprises audio playback components. The audio playback components comprise at least one main speaker, in this case a plurality of main speakers 2, and electronic components 3 arranged to process and transmit audio signals transmitted to the main speakers 2 which play them back by generating sound signals.

The main speakers 2 here comprise at least one treble speaker and at least one medium loudspeaker.

By medium loudspeaker, this means a speaker arranged to play back sounds of intermediate frequencies, i.e. sounds of which the frequency(ies) is/are situated between the low frequencies and the high frequencies (i.e. between the bass sounds and the treble sounds).

By treble speaker, this means a speaker arranged to play back high-frequency sounds. A treble speaker can also be called a tweeter.

The electronic components 3 in particular comprise amplifiers. The electronic components 3 form a plurality of audio channels, each connected to one or more main speakers 2.

The main module 1 additionally comprises main communication components 4 arranged to implement at least one wireless communication. Here, the main communication components 4 can communicate via Wi-Fi technology and via Bluetooth connections.

The main module 1 additionally comprises power supply components 5 arranged to acquire a power supply from the mains. The power supply components 5 can be connected directly to the mains via a cable. The main module 1 can also acquire the power supply coming from the mains by being mounted on a base, itself connected to the mains via a cable.

The main module 1 also comprises an interaction interface 6 comprising buttons and/or sensitive surfaces allowing the interaction and/or the physical control of the main module 1 and of the speaker. Here, the interaction interface 6 comprises only the play/pause buttons, but it could comprise other buttons or sensitive surfaces, for example prev/next buttons.

The main module 1 further comprises main assembly means arranged to assemble the main module 1 with one or more additional modules. It is thus possible to connect one or more additional modules to the main module 1 in order to improve the speaker, which can thus perform additional functions.

The main module 1 additionally comprises a processor component 7, which is adapted to executing instructions of a program to implement the management method which will be described below. The program is stored in a memory module 8 comprising one or more memories of different types (volatile, non-volatile) and connected to or integrated into the processor component 7. For example, the processor component 7 can be a processor, a microcontroller, a digital signal processor (DSP), or indeed a programmable logic circuit such as a field programmable gate array (FPGA) or an application specific integrated circuit (ASIC).

The processor component 7 detects that the main module 1 is connected to one or more additional modules and, if this is the case, activates the additional functionalities associated with said additional modules. By "detects", this means that the processor component 7 itself directly detects the connection or disconnection, or else that it acquires detection signals enabling it to determine if there is a connection or disconnection.

The main module 1 can therefore be used alone, in which case it acts as a Wi-Fi/Bluetooth speaker. The main module 1 can also be assembled with one or more additional modules.

These additional modules include a first additional module 10. A first additional module according to a first embodiment 10*a* can be seen in FIG. 1.

Here, the first additional module 10*a* also has a cylindrical shape with the same radius as that of the main module 1.

The first additional module 10*a* first comprises first assembly means, complementary to the main assembly means, for assembling the first additional module 10*a* to the main module 1.

The first additional module 10*a* additionally comprises a first unit 11 comprising at least one microphone, in this case a plurality of microphones 12. The microphones 12 are positioned on the periphery of the first additional module 10*a* (i.e. on the outer side surface of the cylinder). More specifically, the orifices which enable the sensitive parts of the microphones 12 to communicate with the outside lead to the level of the periphery of the first additional module 10*a*.

The first unit 11 additionally comprises electronic components 13 arranged to acquire and process received audio signals produced by the microphones 12 when these capture sound signals.

The electronic components 13 comprise, in particular, one or more analogue-to-digital converters which convert the analogue signals produced by the microphones 12 into digital signals.

The first unit 11 also comprises first communication components 14 which implement at least one wireless communication, here a Bluetooth connection.

The first additional module 10*a* also comprises a second unit 16 comprising a battery. According to a particular embodiment, the battery can supply power to the speaker when the main module 1 and the first additional module 10*a* are assembled, and when the main module 1 is not connected to the mains.

When the main module 1 and the first additional module 10*a* are assembled, the main module 1 and the first additional module 10*a* are fitted together to form a single-piece smart speaker. The speaker can thus implement the additional functions which can be performed on a smart speaker that requires the presence of microphones. The additional functions here comprise a voice recognition method and a hands-free telephone function.

It is noted that the first additional module 10*a* could possibly be used alone as a Bluetooth A2DP microphone to be associated with a Bluetooth device (computer, smartphone, tablet, etc.).

It is also noted that the battery can be provided solely to power the first additional module 10*a* when this is not assembled with the main module 1 and is therefore not connected to the mains.

Figure 2:
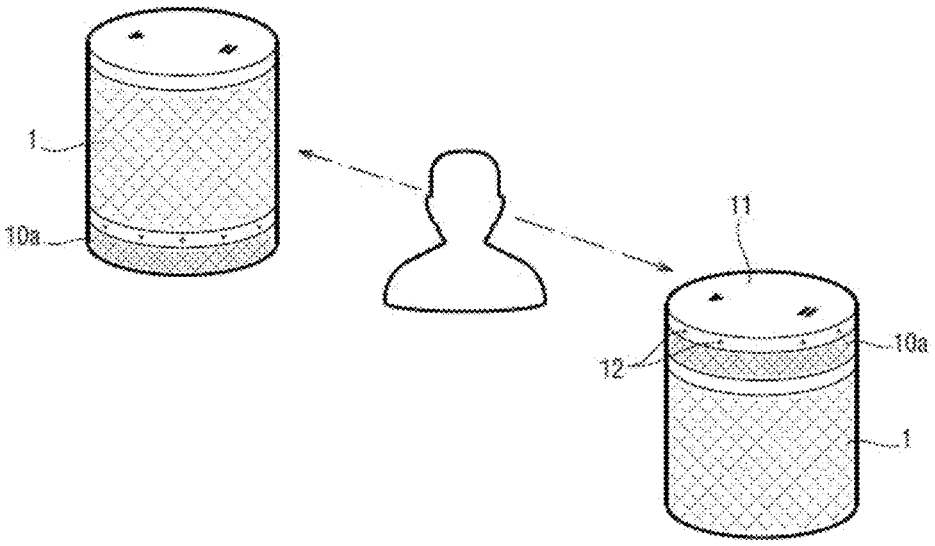
FIG. 2 shows the assembled smart speaker with the main module positioned above and then below the first additional module.

With reference to FIG. 2, the main assembly means make it possible to selectively position the first additional module 10*a* in a lower position below the main module 1 (on the left in FIG. 2) or in an upper position above the main module 1 (on the right in FIG. 2).

Thus, the first additional module 10*a* and therefore the microphones 12 can be positioned in an ideal position according to the location where the speaker is placed. If the speaker is placed in a high position with respect to the user, for example on a high piece of furniture such as a shelf, the user will position the first additional module 10*a* in the lower position. If the speaker is placed in a low position with respect to the user, for example on the floor or on a low piece of furniture such as a table or a sideboard, the user will position the first additional module 10*a* in the lower position.

It is noted that the position of the microphones 12 on the periphery of the first unit 11 here enables these two audio capture positions (high and low).

The presence of the battery and of the first communication components 14 make it possible to easily move the first additional module 10*a* as the user so desires, in order to best benefit from the functionalities of the voice assistant.

The main module 1 and the first additional module 10*a* can thus be connected and engage without being assembled.

Figure 3:
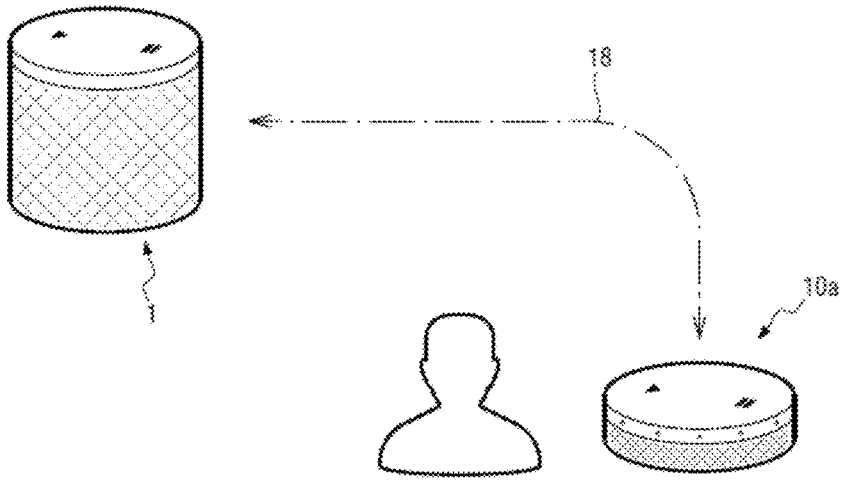
FIG. 3 shows a Bluetooth connection between the main module and the first additional module when these are not assembled.

Thus, with reference to FIG. 3, when the main module 1 and the first additional module 10*a* are not assembled, the main module 1 can receive received audio signals produced by the microphones 12 of the first unit 11 of the first additional module 10*a* to implement the additional functions using the microphones 12. The first additional module 10*a* is therefore remote, and the main module 1 and the first additional module 10*a* use a Bluetooth connection 18 to communicate.

The main module 1 can thus be placed in a semi-fixed position, for example on a shelf, while the first additional module 10*a* can be positioned as close as possible to the user, for example on a table, a kitchen worktop, a desk, etc. Voice capture is thus improved in an environment comprising noise, or when the main module 10*a* is not in direct proximity (but can nevertheless be heard from the position of the user).

The first additional module 10*a* can also, for example, be placed on a table with participants around it, for functions of the conference type.

When the main module 1 and the first additional module 10*a* are assembled, it is possible to make the microphones 12 hidable in order to satisfy the wishes of certain users.

One of the upper or lower positions of the first additional module 10*a* is a hiding position in which the microphones 12 are hidden and therefore insulated acoustically from the outside, such that they cannot capture sound signals coming from the outside.

It is noted that the connection between the main module 1 and the first additional module 10*a* is preferably made via Bluetooth (for example, via the A2DP protocol), but can also be made via Wi-Fi. The Bluetooth connection, through the use of a standard audio protocol, has the advantage of possibly being able to use the first additional module 10*a* as a microphone associated with another device (such as a PC), or another microphone module associated with the main module 1.

Figure 4:
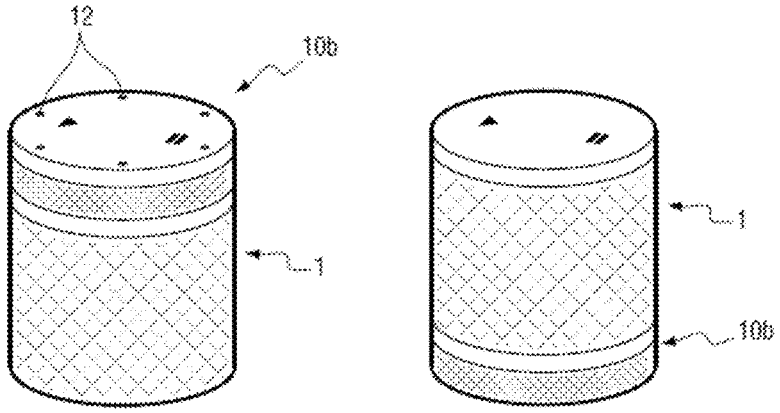
FIG. 4 shows the assembled smart speaker, the main module being positioned below and then above a first additional module according to a second embodiment.

With reference to FIG. 4, the microphones 12 of the first additional module according to a second embodiment 10*b* are positioned here on an upper face of the first additional module 10*b*.

Here, the hiding position of the first additional module 10*b* is therefore the lower position.

When the first additional module 10*b* is positioned in the upper position (on the left in FIG. 4), the orifices of the microphones 12 open outwards and the microphones 12 capture the sound signals coming from the outside. However, when the first additional module 10*b* is positioned in the lower position (on the right in FIG. 4), the microphones 12 are hidden and insulated acoustically from the outside.

This design makes it possible to use the microphones 12 (and therefore to implement the additional functions using the microphones 12) when the main module 1 and the first additional module 10*b* are assembled, but also when the first additional module 10*b* is remote.

If the user wishes to hide the microphones 12, he can also continue to benefit from the "mobile" functions of the speaker, the battery still being present.

Figure 5:
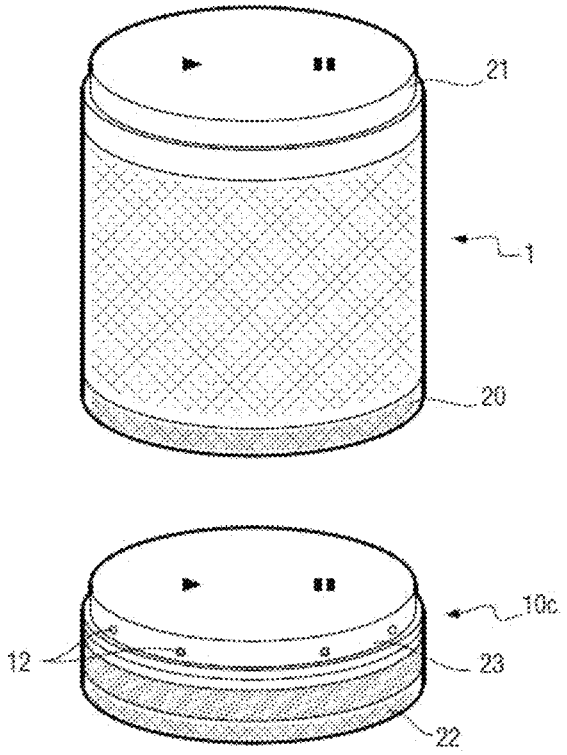
FIG. 5 shows the unassembled smart speaker, the main module being positioned above a first additional module according to a third embodiment.

With reference to FIG. 5, the microphones 12 of a first additional module according to a third embodiment 10*c* are again positioned on the periphery of the first additional module 10*c*.

It can be seen that the main assembly means of the main module 1 comprise a lip 20 which extends over the lower periphery of the main module 1, and a shoulder defining a recess 21 at the level of the upper periphery of the main module 1.

The first additional module 10*c* itself comprises first assembly means also comprising a lip 22 which extends over the lower periphery of the first additional module 10*c*, and a shoulder defining a recess 23 at the level of the upper periphery of the first additional module 10*c*.

When the main module 1 and the first additional module 10*c* are assembled according to the hiding position, i.e. when the first additional module 10*c* is in the lower position, the lip 20 of the main module 1 is positioned in the recess 23 and hides the microphones 12 which are then insulated acoustically from the outside.

Figure 6:
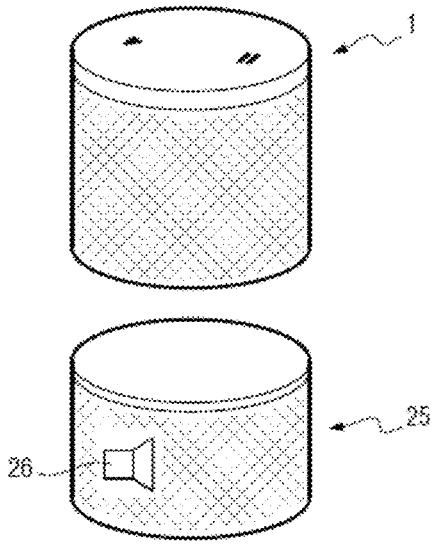
FIG. 6 shows a main module and a second additional module of a speaker which is not assembled.

With reference to FIG. 6, the additional modules also comprise a second additional module 25 comprising a second speaker 26. The second speaker 26 is a bass speaker.

By bass speaker, this means a speaker arranged to play back low-frequency sounds. A bass speaker can also be called a boomer or woofer.

Here, the second additional module 25 itself also has a cylindrical shape with the same radius as that of the main module 1.

Thus, the basic sound quality played back by the speaker can be improved by adding an optional bass speaker.

Figure 7:
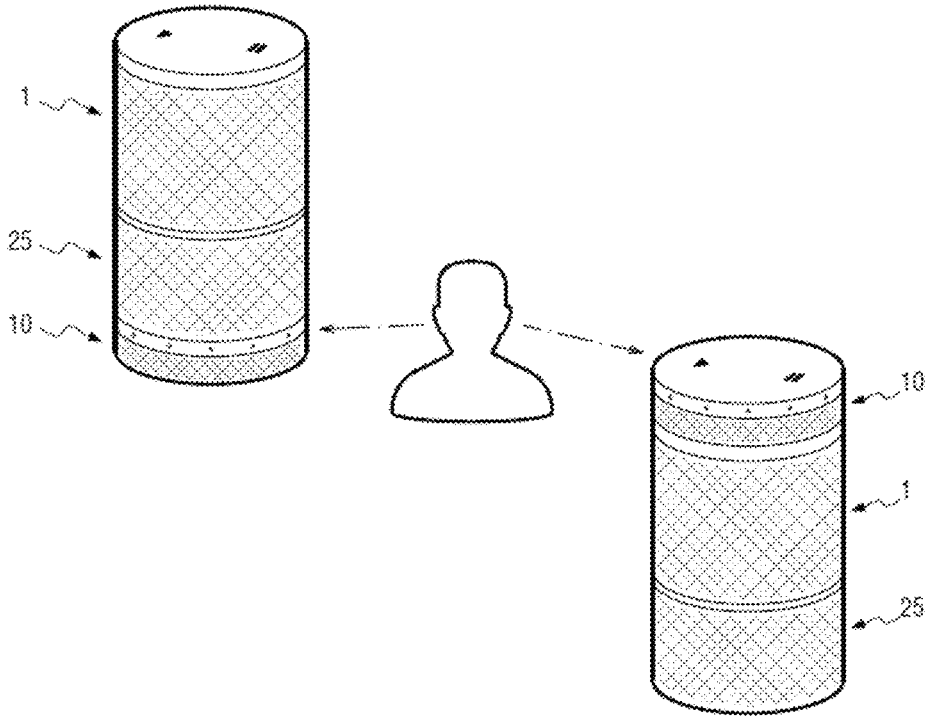
FIG. 7 shows the assembled speaker, the main module being first positioned above the second additional module which is itself positioned above the first additional module, and then the first additional module being positioned above the main module which is itself positioned above the second additional module.

The speaker can thus be assembled according to FIG. 7.

When the speaker must be positioned in a high position, on a shelf for example, the main module 1 is in the upper position, the first additional module 10 is in the lower position, and the second additional module 25 is between the main module 1 and the first additional module 10. On the contrary, when the speaker must be positioned in a low position, on a table for example, the first additional module 10 is in the upper position, the second additional module 25 is in the lower position, and the main module 1 is between the first additional module 10 and the second additional module 25.

Advantageously, it is provided that the speaker is capable of applying different audio profiles according to the presence or not of the second additional module 25 (and therefore of the bass speaker 26).

The processor component 7 of the main module 1 detects whether the main module 1 is assembled or not with the second additional module 25 and adapts the audio profile of the speaker (and in particular, of the main module 1) according to the result of the detection.

For example, the frequency response of the main module 1 can be reduced when the second additional module 25 is present, in order to benefit, over the frequency range reproducible both by the main module 1 and by the second additional module 25, from the best quality audio playback which is proposed by the second additional module 25.

Figure 8:
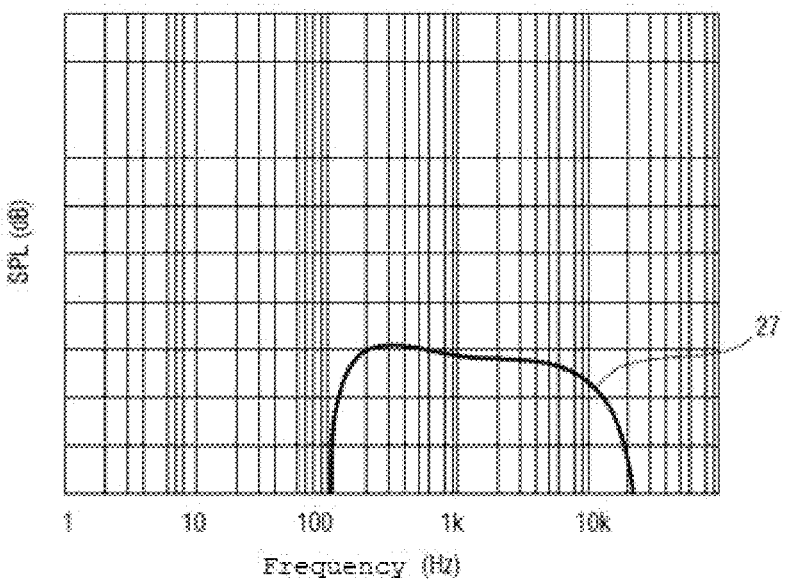
FIG. 8 is a graph comprising a frequency response curve of a speaker containing only the main module.

Thus, FIG. 8 shows the curve 27 of the frequency response of the speaker when the second additional module 25 is not present (i.e. the frequency response of the main module 1).

Figure 9:
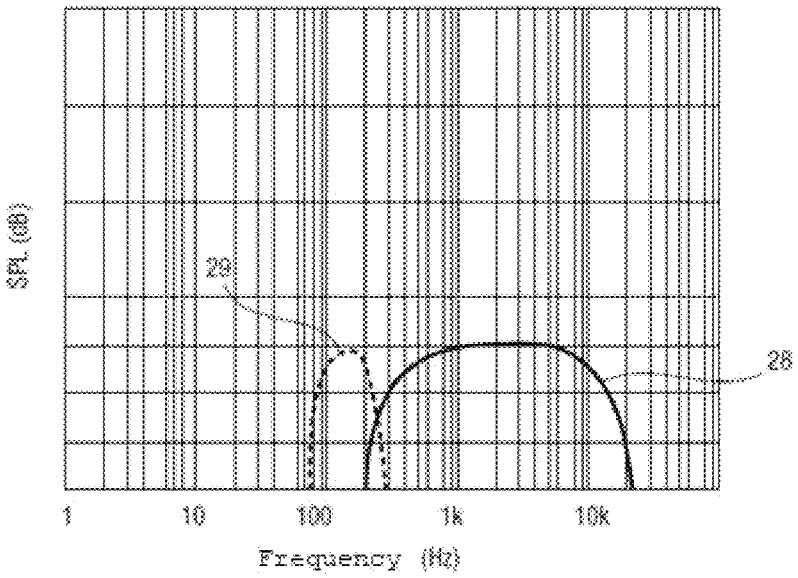
FIG. 9 is a graph comprising a frequency response curve of the main module and the second additional module when they are used together.

FIG. 9 shows the curve 28 of the frequency response of the main module 1 and the curve 29 of the frequency response of the second additional module 25 when the main module 1 and the second additional module 25 are assembled. The frequency response of the main module 1 is reduced in the bass.

Advantageously, the first unit 11 of the first additional module 10 (comprising the microphones 12) and the second unit 16 of the first additional module 10 (comprising the battery) are detachable and can each be assembled individually with the main module 1.

Figure 10:
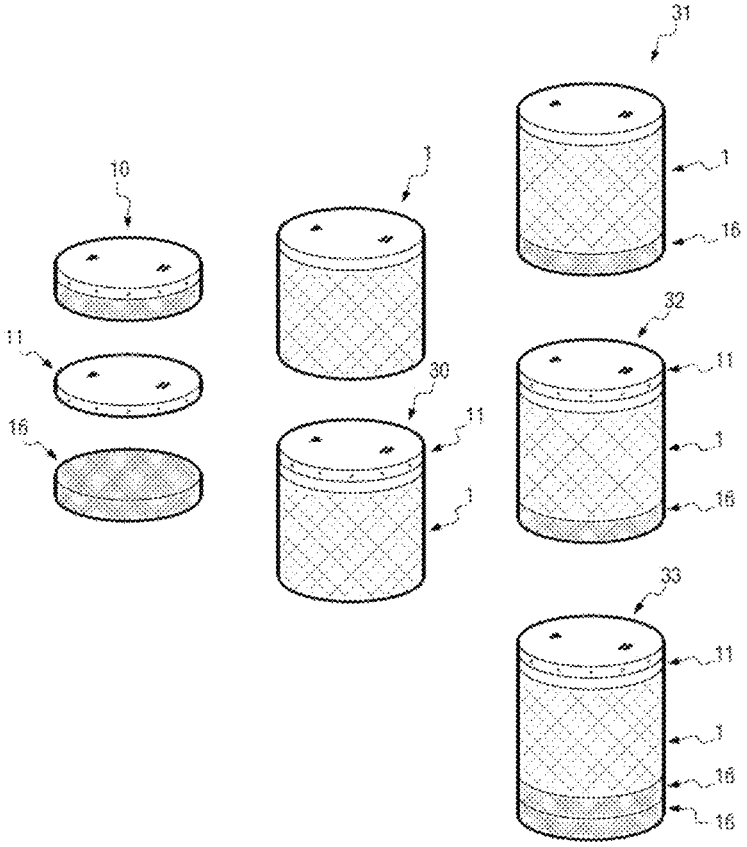
FIG. 10 shows different possible configurations of the speaker.

The combinations of FIG. 10 thus become possible.

As the first unit 11 and the second unit 16 of the first additional module 10 are detachable, the first unit 11 can be assembled with the main module 1 (without the second unit 16) to obtain a smart speaker 30 capable of implementing the additional functions requiring the microphones 12.

The second unit 16 can itself also be assembled with the main module 1 (without the first unit 11) to obtain a mobile speaker 31.

The first unit 11 and the second unit 16 can also be detached and assembled, both with the main module 1 in order to obtain a mobile smart speaker 32. It is also possible to use two second units 16, i.e. two batteries, to obtain a mobile smart speaker 33 having dual autonomy.

It is thus possible to avoid the cost of the battery when the speaker is systematically used in a "sedentary" configuration (connected to the mains), or on the contrary, to improve the autonomy of the speaker in a "mobile" configuration by using one or more batteries.

Attention is now given to the various connections between the modules when these are assembled.

Figure 11:
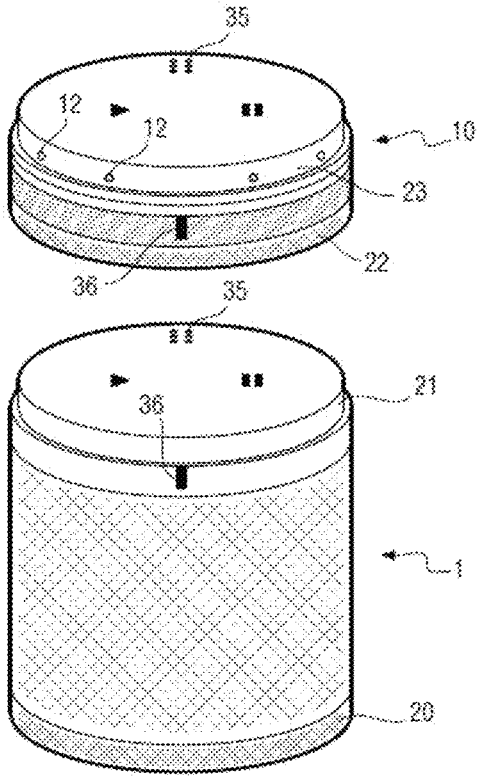
FIG. 11 shows the unassembled smart speaker, the main module positioned below the first additional module.

Reference is made to FIG. 11.

The electrical connection between the main module 1 and the first additional module 10 allows a power supply transfer and a data transfer.

The power supply transfer consists either in transferring from the main module 1 to the first additional module 10, a first power supply current at a first power supply voltage (produced by the mains) when the main module 1 is connected to the mains, or in transferring from the first additional module 10 to the main module 1 a second power supply current at a second power supply voltage (produced by the battery) when the main module 1 is not connected to the mains.

The data transfer consists in transferring various data between the main module 1 and the first additional module 10 and, in particular, received audio signals produced by the microphones 12 of the first additional module 10 to the main module 1.

The electrical connection can be made in different ways.

It is possible to use spring connectors, such as Pogo connectors. In this case, the spring pins 35 (Pogo pins) are, for example, placed on the top of each module, and the corresponding "flat" contact surfaces are placed on the bottom of each module.

The reverse configuration (contact surfaces on the top, and spring pins on the bottom) is, of course, possible. The reverse configuration improves the appearance of the speaker.

Other solutions can be considered, like for example, the use of flexible connectors that are inserted into sockets located behind the modules. This could, for example, be USB-C type connectors, making it possible to transport both the power supply and the data.

It is also possible to provide each module with one or more windings for implementing inductive couplings making it possible to transfer power and data between the modules. The windings can be made by tracks on a high-frequency printed circuit and by low-frequency coils.

Of course, the above also applies to the electrical connection between each module.

The mechanical connection of the different modules is achieved by engagement. Below, "lower module" and "upper module" will be used to mean two modules assembled together and one above the other.

As has been seen, a shoulder defining a recess 21, 23 is present here on the upper periphery of each module 1, 10. A lip 20, 22 is present on the lower periphery of each module 1, 10. When the two modules are engaged, the lip of the upper module is positioned in the recess of the lower module.

Advantageously, each lip is made of a compressible material, for example rubber. The lip can thus ensure:

- correct centring of the modules when they are stacked;
- damping of potential vibrations between the modules (due to the speakers);
- stability/immobility on the surface on which the assembly is placed;
- acoustic seal (if necessary) between the modules (and in particular the hiding of the microphones 12, as has been seen above).

Thus, the upper module can be the main module 1 and the lower module can be the first additional module (see FIG. 5). In this case, when the main module 1 and the first additional module 10 are assembled according to the hiding position, the lip 20 of the main module 1 is positioned in the recess 23 of the first additional module 10 and hides the microphones 12 which are then insulated acoustically from the outside.

A visual alignment mark 36 is present on each module to assist the user in positioning the modules. A magnet system (located on the top and bottom of the modules) can help to achieve the correct alignment. An engagement system with mechanical locking can also be used.

Numerous other mechanical solutions are possible. For example, the arrangement seen in FIG. 12 can be used. This arrangement makes it possible to improve both the positioning, the engagement, and the appearance of the speaker.

A flat zone 38 is formed on a rear part of a lower module, in the periphery of the recess. The module in question is any one of the modules previously presented (for example, the first additional module 10).

The lip of the upper module (for example, the main module 1) also comprises a complementary flat zone. The flat zones guarantee the correct positioning and the correct relative orientation of the modules without needing to resort to magnets.

It is noted that the Pogo pins 39 can be positioned in the flat zone 38 and extend vertically from said flat zone 38. The Pogo pins 39 are therefore not located on the upper face of the speaker, which improves its appearance.

Figure 12:
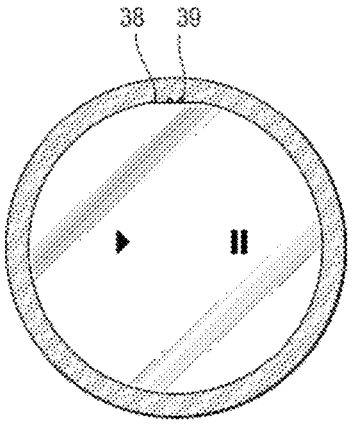
FIG. 12 is a top view of one of the modules.

In FIG. 12, the Pogo pins 39 are positioned on an upper part of the lower module, and therefore the corresponding contact surfaces are positioned on a lower part of the upper module, in this case, on an inner surface of the lip. The reverse configuration is possible (retractable pins on the upper part of the modules and contact surfaces on the lower part of the modules), in which case the retractable pins extend from the inner surface of the lip of the upper module and cannot even be seen on the rear of the speaker, which improves its appearance.

Attention is now given to the management of the different states of the speaker, which depend on the additional modules assembled with the main module 1.

It is the processor component 7 of the main module 1 which manages these various states. It is relevant to implement the management method in the main module 1, as it is the only module necessary for the operation of the speaker, the additional modules being optional.

The management method makes it possible to use different audio profiles according to the use or not of the second additional module 25 (and therefore the bass speaker 26) is used.

The management method also makes it possible to use different power supply profiles according to the connection or not of the speaker to the mains, and according to the presence or the absence of the battery.

The management method also makes it possible to activate the additional functions using the microphones 12 if these are present.

Figure 13:
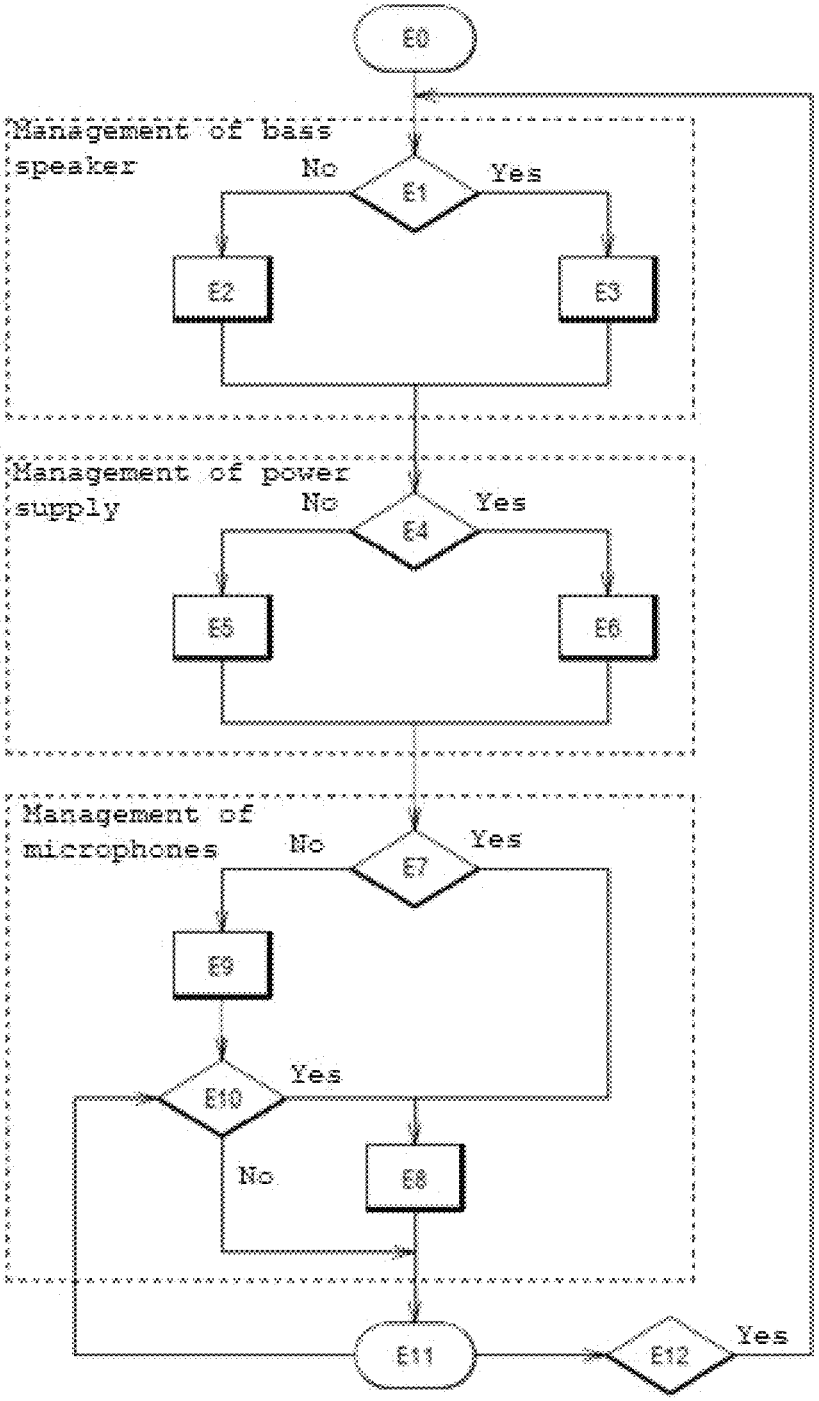
FIG. 13 shows steps of the management method according to the invention.

The management method implemented by the processor component 7 will now be described in detail, with reference to FIG. 13.

The management method starts with an initialisation step E0.

The processor component 7 thus detects if the main module 1 is assembled or not with the second additional module 25, in order to determine the audio equalisation profile to be adopted (step E1).

Of course, in the case where the second module 25 is not provided by the manufacturer (and therefore is not manufactured), this first detection step E1 is not performed.

The detection of the second additional module 25 can be made in different ways.

For example, the detection of the second additional module 25 can consist in detecting if data is circulating on the pins dedicated to the transfer of data of the electrical connection. In this case, it will be advantageous to use a communication bus (for example, USB or I2C), in order to enable discovery and identification of the modules.

The detection can also consist in measuring the impedance at the pins on which an analogue audio signal intended for the bass speaker 26 of the second additional module 25 circulates. Verification of the impedance of this connection makes it possible to detect the presence of the second additional module 25, without this implying that the second additional module 25 is able to communicate on a digital bus. This reduces the cost of the second additional module 25.

The processor component 7 thus adapts the audio profile applied by the speaker according to the result of this detection.

If the processor component 7 does not detect the presence of the second additional module 25, the processor component 7 activates the audio profile adapted to the absence of a bass speaker (step E2). Otherwise, the processor component 7 activates the audio profile adapted to the presence of the bass speaker 26 (step E3).

Steps E1 to E3 therefore relate to the management of the second additional module 25 (and therefore of the bass speaker 26).

Then, in step E4, the processor component 7 detects if the main module 1 is connected or not to the mains for its power supply. Optionally, the processor component 7 also detects if the main module 1 is assembled or not with the first additional module 10 (or at least with the second unit 16 of the first additional module 10), in order to detect if the battery is indeed present.

The processor component 7 thus adapts the power supply profile according to the result of this detection.

If the processor component 7 detects that the main module 1 is not connected to the mains, the processor component 7 activates the power supply profile adapted to the presence of the battery (step E5). Otherwise, the processor component 7 activates the power supply profile adapted to the power supply via the mains (step E6).

The power supply profile adapted to the presence of the battery includes the implementation of certain adjustments consisting, for example, of limiting the acoustic power, of decreasing the time before standby/shutdown of the speaker, of activating advanced Wi-Fi power saving functions, etc.

In the case where the speaker is connected to the mains, but the battery is present, the processor component 7 also activates the charging of the battery.

Steps E4 to E6 therefore relate to power supply management.

It is noted that steps E1 to E3 and E4 to E6 could be completely reversed.

The processor component 7 then detects if the main module 1 is assembled with the first additional module 10 (or at least with the first unit 11 of the first additional module 10): step E7.

If this is the case, this means that the microphones 12 are present locally. The processor component 7 therefore activates the additional functions using the microphones 12 (step E8). Activation is done according to the configuration of the speaker or according to user parameters.

The detection of the first additional module 10 (or the first unit 11) can be made in different ways.

For example, the detection of the first additional module 10 can consist in detecting if data is circulating on the pins dedicated to the transfer of data of the electrical connection. In this case, it will be advantageous to use a communication bus (for example, USB or I2C), in order to enable discovery and identification of the modules.

If the microphones 12 are not locally present, the processor component 7 of the main module 1 activates the Bluetooth connection to attempt to detect the first additional module 10: step E9.

The processor component 7 verifies that the main module 1 has detected the first additional module 10 (and therefore the presence of the microphones): step E10.

If this is the case, the processor component 7 connects the main module 1 to the first additional module 10 and activates the additional functions using the microphones 12 (step E8).

If the microphones 12 are not detected, the detection continues in the background during nominal use of the speaker (the first additional module 10 being able to be subsequently switched on): step E11.

Steps E7 to E10 therefore relate to the management of the microphones.

It is noted that it is completely possible for the main module 1 to communicate with the microphones via a Bluetooth connection, even if the microphones 12 are locally present. The electrical connection between the main module 1 and the first additional module 10 is thus used only for power supply, without data transfer. In this case, the "local detection" test of the microphones of step E7 is not performed, and the detection of the microphones 12 is made via the Bluetooth connection.

Advantageously, the speaker is designed to accept and manage the hot-swap insertion and removal of the additional modules. Thus, during the nominal operation of the speaker, the processor component 7 attempts to detect the connection or disconnection of an additional module (step E12). If a module change is detected, the speaker is reconfigured based on the module change. The detection steps E1 to E10, which have been performed upon start-up of the system, are then again performed, as well as the adjustments of parameters/profiles which result therefrom.

In the case of the insertion/removal of the second additional module 25, the audio playback continues with the appropriate equalisation profile.

In the case of disconnection of the mains supply, the speaker goes into the "battery powered" power supply profile. Conversely, in the case of the connection of the mains supply, the product goes into the "mains" power supply profile.

In the case of (local) insertion/removal or in the case of connection/disconnection through the Bluetooth connection of the first additional module 10, the functions related to the microphones 12 are activated/deactivated.

Of course, the invention is not limited to the embodiment described, but encompasses any variant entering into the field of the invention, such as defined by the claims.

The modular audio playback equipment according to the invention is not necessarily a speaker, but can be any electronic equipment integrating one or more speakers and one or more microphones: residential gateway, set-top box, voice assistant, etc.

It is, of course, possible to provide additional modules different from those described here. The first additional module could, for example, comprise a bass speaker. The additional modules could implement other additional functions: improvement of audio playback, conventional functions of smart objects, etc.

Communication between modules, when they are not assembled, can use any type of technology (in particular, radio or optical).

The invention claimed is:

1. Modular audio playback equipment comprising a main module and one or more additional modules comprising a first additional module, the main module being arranged to operate individually or by being assembled with the one or more additional modules, the first additional module comprising at least one microphone, the main module comprising:

audio playback components comprising a main speaker;

main communication components arranged to implement at least one wireless communication;

power supply components arranged to acquire main power from a power source and to power the equipment from the main power supply;

main assembly means arranged to assemble the main module with the one or more additional modules;

a processor component arranged to detect if the main module is assembled with the first additional module and, if this is the case, to activate at least one additional function implemented by the equipment and using the at least one microphone, the at least one additional function comprising a voice recognition method and/or a hands-free telephone function, the at least one additional function being deactivated if the main module is not assembled with the first additional module;

the first additional module additionally comprising a battery arranged to power the equipment when it is not connected to the power source, and the main module and the first additional module are assembled.

2. The equipment according to claim 1, the battery being arranged to power the first additional module when said additional module is not connected to the power source and is not assembled with the main module.

3. The equipment according to claim 1, the first additional module comprising a first unit comprising the at least one microphone and a second unit comprising the battery, the first unit and the second unit being detachable and each being capable of being assembled individually with the main module.

4. The equipment according to claim 1, the processor component being arranged to detect if the main module is connected or not to the power source, and to adapt a power supply profile of the equipment according to the result of this detection.

5. The equipment according to claim 1, the first additional module comprising first communication components arranged to communicate with the main communication components of the main module via wireless communication, the main module being arranged to, when the main module and the first additional module are not assembled, receive via wireless communication, audio signals produced by the at least one microphone of the first additional module to perform the at least one additional function.

6. The equipment according to claim 1, in which the main assembly means are arranged to allow the first additional module to be selectively positioned in an upper position above the main module or in a lower position below the main module.

7. The equipment according to claim 6, in which one of the upper position or lower position is a hiding position in which the at least one microphone of the first additional module are hidden.

8. The equipment according to claim 7, the main assembly means comprising a lip which extends over a periphery of the main module, the first additional module having a shoulder defining a recess over a periphery of the first additional module, the main module and the first additional module being arranged such that, when the main module and the first additional module are assembled according to the hiding position, the lip is positioned in the recess and hides the at least one microphone which are then insulated acoustically from the outside.

9. The equipment according to claim 8, in which pins, arranged to implement an electrical connection between the main module and the first additional module, extend from an inner surface of the lip.

10. The equipment according to claim 1, in which the additional modules comprise a second additional module comprising an additional speaker.

11. The equipment according to claim 10, in which the main speaker comprises a medium speaker and/or a treble speaker and in which the additional speaker comprises a bass speaker.

12. The equipment according to claim 10, the processor component being arranged to detect if the main module is assembled or not with the second additional module and to adapt an audio profile applied by the equipment according to the result of this detection.

13. The equipment according to claim 1, the equipment being a speaker.

14. A management method, implemented in the equipment according to claim 1 and comprising steps of:

detecting if the main module is assembled with the first additional module;

if this is the case, of activating the at least one additional function performed by the equipment and using the at least one microphone.

15. The management method according to claim 14, further comprising steps, if the main module is not assembled with the first additional module:

of activating the wireless communication to attempt to detect the first additional module;

if the first additional module is detected, of connecting the main module with the first additional module and activating the at least one additional function implemented by the equipment and using the at least one microphone.

16. The management method according to claim 14, further comprising steps:

of detecting if the main module is assembled or not with a second additional module comprising an additional speaker;

of adapting an audio profile applied by the equipment according to the result of this detection.

17. The management method according to claim 14, further comprising steps:

of detecting if the main module is connected or not to the power source for its power supply;

of adapting a power supply profile of the equipment according to the result of this detection.

18. A non-transitory computer readable storage medium storing instructions that cause the processor component of the main module of the equipment according to claim 1 to execute a management method comprising steps of:

detecting if the main module is assembled with the first additional module;

if this is the case, of activating the at least one additional function performed by the equipment and using the at least one microphone.

* * * * *